United States Patent [19]

Miyahara

[11] 3,941,517

[45] Mar. 2, 1976

[54] MAGNETIC HYDRAULIC PUMP

[75] Inventor: Kingo Miyahara, Tokyo, Japan

[73] Assignee: Dowa Co., Ltd., Japan

[22] Filed: Sept. 11, 1974

[21] Appl. No.: 504,976

[30] Foreign Application Priority Data

Sept. 29, 1973 Japan ..... 48-114256[U]

[52] U.S. Cl. ..... 417/420; 417/430; 259/96

[51] Int. Cl.[2].. F04B 17/00; F04B 21/00; B01F 5/16

[58] Field of Search ..... 417/420, 430, 431; 259/96; 415/116

[56] References Cited

UNITED STATES PATENTS

| | | | |
|---|---|---|---|
| 2,885,126 | 5/1959 | Hudson | 417/420 UX |
| 3,299,819 | 1/1967 | McCoy | 417/420 |

*Primary Examiner*—Carlton R. Croyle
*Assistant Examiner*—Richard E. Gluck
*Attorney, Agent, or Firm*—Hill, Gross, Simpson, Van Santen, Steadman, Chiara & Simpson

[57] ABSTRACT

A hydraulic pump is disclosed, which comprises a first permanent magnet magnetized alternately with positive and negative polarities and surrounding a rotary shaft, and having a pump casing provided in opposed relation to said first permanent magnet, and a second permanent magnet provided within a pump chamber in said pump casing on the side opposite said first permanent magnet and magnetized with alternately positive and negative polarities like said first permanent magnet, and a rotor having blades and provided within said pump casing in rotatable relation on the other side thereof, whereby the rotation of the rotor may be automatically stopped in case an excessive load is applied to the rotor and, in addition, different kinds of liquid may be completely mixed therein.

2 Claims, 2 Drawing Figures

MAGNETIC HYDRAULIC PUMP

This invention relates to a novel but improved hydraulic pump adapted to deliver liquid.

The objects of the invention is to provide a hydraulic pump, wherein a rotor and a rotary shaft rotate in a synchronous relation but in a floating fashion under attracting and repulsing actions of a pair of permanent magnets positioned in an opposed relation to each other and magnetized so as to provide alternately opposite polarities, said rotor being independent of said rotary shaft, thereby effecting the feeding action of liquid, and wherein troubles are prevented beforehand by automatically stopping the rotation of the rotor, in the event that an unreasonable load is exerted on the rotor.

Hitherto, with a hydraulic pump for use in delivering water, oil and other kinds of liquid in a given amount, a rotor is directly coupled to a rotary shaft for rotation together with the latter. Accordingly, if for some reason or another, an unreasonable load is applied on the blades of the rotor during its high speed rotation in the course of delivery of liquid, the load will be directly imposed on the blades or rotary shaft, resulting in rupture of a pump or rotary shaft which in turn leads to the interruption of delivery of liquid. The inventor has proposed to avoid the aforesaid shortcomings by causing the rotor to rotate in a synchronous manner with the rotary shaft, rather than by directly coupling the rotor to the rotary shaft, with the aid of permanent magnets disposed in facing relation to each other so as to present opposite polarities alternatively. However, such an attempt resulted in the failure to obtain normal rotation of the rotor, because the rotor was inclined and considerable degree of wear was caused to the bearing. This is because there is provided opposed permanent magnets, each having only one pair of opposite polarities, so that the resulting strong attracting force attracts the rotor towards the rotary shaft side, resulting in a non-uniform magnetic force to be exerted on the entire surface of the magnet.

It is accordingly an object of the present invention to provide a hydraulic pump, wherein an annular permanent magnet magnetized alternately with a plurality of positive and negative polarities in a common plane is directly coupled to the rotary shaft, and an annular permanent magnet magnetized alternately with a plurality of positive and negative polarities as the former permanent magnet is placed in opposed relation to said former permanent magnet and journaled within a pump casing, whereby a rotor may smoothly rotate in a floating and synchronous fashion under attracting and repulsing actions of the permanent magnets, and whereby the rotation of the aforesaid rotor may be stopped automatically, in case an excessive load is applied to the aforesaid rotor.

It is another object of the present invention to provide a hydraulic pump, wherein there is provided agitating grooves in parallel cross-shaped grooves formed in the inner surface of a cover plate forming one side wall of the pump casing, in which the rotor of the aforesaid construction is housed and journaled, with at least one of the aforesaid agitating grooves communicating with a suction port for a liquid of a different kind, whereby at least two different kinds of liquid may be completely mixed with each other within the pump casing to deliver one phase of liquid.

These and other objects and features of the present invention will be apparent from a reading of the ensuing part of the specification in conjunction with the accompanying drawings which indicate the preferred embodiments of the present invention.

BRIEF DESCRIPTION OF THE DRAWINGS

In the drawings, FIG. 1 is a longitudinal cross-sectional view, partly broken, of a hydraulic pump according to the present invention and FIG. 2 is an exploded perspective view of the essential part of the hydraulic pump. Like parts are designated like reference numerals throughout FIGS. 1 and 2.

Figure 1:
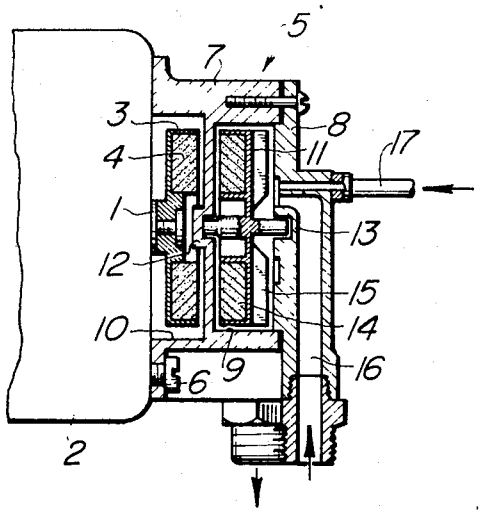
FIG. 1 is a cross sectional view of the invention.
Figure 2:
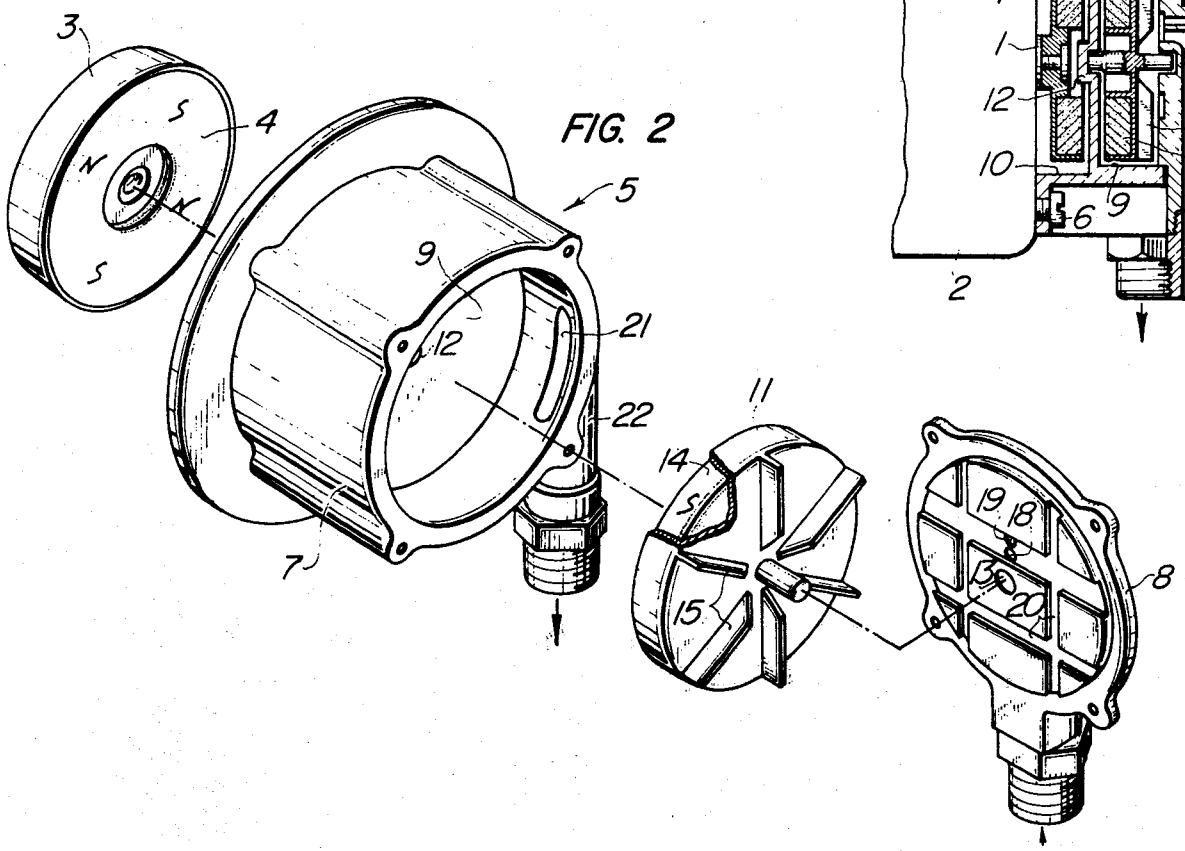
FIG. 2 is an exploded view of the invention.

Shown at 1 is a rotary shaft which is rotated at a high R.P.M. by means of a suitable electric motor 2. The rotary shaft 1 is directly coupled to the electric motor 2. Shown at 3 is an attaching member which is removably attached to the end portion of the rotary shaft 1 and made of non-magnetic metal or synthetic resin and the like. The attaching member 3 contains therein an annular permanent magnet 4 magnetized with positive polarities and negative polarities arranged alternately. A pump casing 5 is attached by the medium of several attaching means 6 to the electric motor 2, with the attaching member 3 facing the electric motor 2. The pump casing 5 consists of a body portion 7 and a cover plate 8 made of non-magnetic metal or synthetic resin, and a hollow pump chamber 9 is defined inwardly of the body portion 7 and the cover plate 8. Defined in the body portion 7 on one side thereof is a concave chamber 10 in which is fitted the permanent magnets 4. Rotatably provided in the pump chamber 9 is a rotor 11 which is journaled in bearings 12, 13 provided in the body portion 7 and the cover plate 8, respectively. Provided on one side of the aforesaid rotor 11 is an annular permanent magnet 14 magnetized with positive and negative polarities arranged alternately, which faces the former permanent magnet 4. Integrally anchored in one side of the permanent magnet 4 are blades extending radially outwardly. Integrally or separately provided in the outer surface of the cover plate 8 are a suction path 16 for delivering liquid, such as for instance, liquid fuel therethrough and a suction pipe 17 for delivering a liquid different from the former liquid, such as water or other liquid fuel and the like. Suction ports 18, 19 of the suction path 16 and suction pipe 17 are located close to an eccentric portion of the pump chamber 9. On the other hand, provided in the inner surface of the cover plate 8 are agitating cross-shaped grooves 20, with at least one of the agitating grooves 20 being in communication with the liquid suction ports 18, 19. In passing, the aforesaid suction ports 18, 19 may be spaced a distance from each other in a manner that the suction ports 18, 19 communicate with the agitating grooves in different positions. Shown at 21 is a liquid delivery port provided in one side of the pump chamber 9, through which a mixture of the different kinds of liquids is delivered through a liquid delivery pipe 22 which communicate with the liquid delivery port 21.

Accordingly, if a hydraulic pump is provided on the side opposite to the rotary shaft 1 as shown in FIG. 1, the rotor 11 will be in an attracted condition due to an attracting force of the permanent magnets 4 and 14 alternately having positive and negative polarities. Thus, if the rotary shaft 1 starts to rotate by means of the electric motor 2 and the like, permanent magnet 14 on the side of the rotor 11 will be attracted or repulsed by the magnet 4, with the rotation of the permanent magnet 4 on the side of the rotary shaft 1, thereby presenting the so-called floating condition. This floating condition takes place at the start of the rotation of rotary shaft 1 until normal rotation speed is attained. Thus, as the rotary shaft 1 gradually increases R.P.M. in one direction, the rotor 11 will maintain its floating condition, whereby the liquid which has been introduced by way of a liquid suction path 16 and a liquid suction pipe 17 into a pump chamber 9 will be delivered through a liquid delivery port 21 and a liquid delivery pipe 22 to a desired position. Meanwhile, if for some reason or other, if a load is applied overcoming the attracting magnetic force created between the permanent magnets 4 and 14, the rotation of the rotor 11 will be automatically stopped, despite the rotation of rotary shaft 1, with the resulting interruption of delivery of liquid, so that troubles will be prevented beforehand, and the rotary shaft 1, pump casing 5 and rotor 11 will not have an unreasonable load applied thereto.

Under such a condition, if different kinds of liquid are introduced under suction by way of liquid suction ports 18, 19 of liquid suction path 16 and liquid suction pipe 17 into the pump chamber 9, then the different kinds of liquids which have been introduced under suction from a number of directions along agitating grooves 20 into the pump chamber 9 will be agitated for mixing by means of blades 15 and agitating grooves 20 to thereby present a completely mixed liquid, since the aforesaid liquid suction ports 18, 19 are in communication with one of the cross-shaped agitating grooves 20 defined in the inner surface of the cover plate 8. In this respect, particularly in case where liquid fuel and water are to be mixed, there will result an emulsion containing fine foam therein which will be splashed under the centrifugal force of the blades 15 against the peripheral wall, whereby it will be delivered through the liquid delivery port 21 into the liquid delivery pipe 22, and then to the exterior.

Accordingly, even if different kinds of liquids are such as will hardly be mixed, then will be agitated and mixed in the pump chamber 9, presenting a completely mixed liquid mixture which is delivered at a constant flow rate.

In short, according to the present invention, the pump casing 5 is provided independently of but in opposed relation to the permanent magnet 4 having alternately different positive and negative polarities and adapted to be rotated at a high R.P.M. by means of the rotary shaft 1, and in addition, there is provided within the pump chamber 9 in the pump casing 5 on one side thereof a plurality of permanent magnets 14 having alternately different positive and negative polarities like the aforesaid permanent magnet 4, while a rotor 11 having a radially extending blades 15 is provided within the pump chamber 9 on the other side thereof in rotating relation, whereby the rotor 11 may effect acurate synchronous rotation in a floating condition under the attracting and repulsing forces of permanent magnets 4 and 14 without being displaced to one side, thereby effecting an efficient delivery action. In this respect, if for some reason or another, an excessive load is applied to the rotor itself, then the rotation of rotor 11 will be instantaneously stopped, with the accompanying interruption of the liquid delivering action. As a result, the present invention precludes the possibility of rotor 11 being rotated under an excessive load, so that not only rotary shaft 1 but also rotor 11 will not be damaged, thus eliminating troubles such as experienced with the conventional devices of this kind. In addition to this, since the rotor 11 is positively journaled on a shaft within the pump casing 5, the leak of liquid through a shaft hole may be completely prevented, while providing efficient delivery action, despite simple and less costly construction.

Furthermore, according to the hydraulic pump of the present invention, the different kinds of liquid which have been forced out through the liquid suction ports 18, 19 under suction created due to the rotation of the blades 15 will be introduced under suction into the pump chamber 9 from every direction along the agitating grooves 20 for agitation and mixing by means of blades 15 and agitating grooves 20, thereby delivering a single phase liquid to the exterior.

If the hydraulic pump according to the present invention is used as a burner, liquid such as kerosene may be completely mixed with water, so that water is used as part of liquid fuel for complete combustion.

What is claimed is:

1. A magnetic pump for agitating different kinds of liquid, comprising:

a drive shaft, first permanent magnet means having alternately different positive and negative polarities and surrounding and attached to said drive shaft, a pump casing provided in opposed relation to said first permanent magnet means and defining a pump chamber therein, a cover plate forming one side wall of said pump chamber, a rotor rotatably provided in said chamber, second permanent magnet means fixed to said rotor on a side facing to said first permanent magnet means and having alternately different polarities arranged similar to those on said first permanent magnet means, blades provided on said rotor on the side opposed to said second permanent magnet means, agitating cross-shaped grooves formed in the inner surface of said cover plate forming one side wall of said pump chamber, a pair of inlet ports formed in said cover plate and communicating with at least one of said agitating grooves for introducing under suction different kinds of liquid, and an outlet port formed in said pump casing and communicating with said pump chamber.

2. A magnetic pump for agitating different kinds of liquid, comprising:

a drive shaft, first permanent magnet means having alternately different positive and negative polarities and surrounding and attached to said drive shaft, a pump casing provided in opposed relation to said first permanent magnet means and defining a pump chamber therein, a cover plate forming one side wall of said pump chamber, a rotor rotatably provided in said chamber, second permanent magnet means fixed to said rotor on a side facing to said first permanent magnet means and having alternately different polarities arranged similar to those on said first permanent magnet means, blades provided on said rotor on the side opposed to said second permanent magnet means, agitating cross-shaped grooves formed in the inner surface of said cover plate forming one side wall of said pump chamber, an inlet port formed in said cover plate and communicating with at least one of said agitating grooves for introducing liquid, and an outlet port formed in said pump casing and communicating with said pump chamber.

* * * * *